US005702166A

United States Patent [19]

Lee

[11] Patent Number: 5,702,166

[45] Date of Patent: Dec. 30, 1997

[54] INFORMATION KIOSKS

[75] Inventor: James Michael Lee, Windermere, Fla.

[73] Assignee: Lockheed Martin Corporation, Bethesda, Md.

[21] Appl. No.: 489,315

[22] Filed: Jun. 9, 1995

[51] Int. Cl.[6] ..... A47B 87/00

[52] U.S. Cl. ..... 312/107; 312/198; 312/239; 312/223.3; 312/311; D14/130; D20/10

[58] Field of Search ..... 312/7.2, 107, 111, 312/108, 198, 208.2, 239, 249.9, 223.3, 223.4, 311, 285, 249.8, 293.2, 290, 194, 196; 52/27.5, 27; D6/421, 455; D14/130; D20/10; D99/28

[56] References Cited

U.S. PATENT DOCUMENTS

| | | | |
|---|---|---|---|
| D. 220,767 | 5/1971 | Power | D6/421 |
| D. 331,055 | 11/1992 | Massey et al. | D14/130 X |
| 1,280,619 | 10/1918 | Leick | 108/25 X |
| 2,059,994 | 11/1936 | Williams | 312/194 X |
| 3,858,528 | 1/1975 | Petersen | 312/196 X |
| 4,669,790 | 6/1987 | Briggs | 312/223.3 |
| 4,766,422 | 8/1988 | Wolters et al. | 312/223.3 X |
| 4,828,340 | 5/1989 | Jorgensen | 312/311 X |
| 4,861,121 | 8/1989 | Gotz | 312/223.3 |
| 5,271,669 | 12/1993 | Pearlson | 312/223.3 X |

FOREIGN PATENT DOCUMENTS

| | | | |
|---|---|---|---|
| 455244 | 11/1991 | European Pat. Off. | 312/223.3 |
| 2645728 | 10/1990 | France | 312/7.2 |

*Primary Examiner*—Peter M. Cuomo
*Assistant Examiner*—Janet M. Wilkens
*Attorney, Agent, or Firm*—Burns, Doane, Swecker & Mathis, L.L.P.

[57] ABSTRACT

An information kiosk serving as an interactive information source for multiple users including users in wheelchairs. The information kiosk includes eight modular units which are connected to one another to form a ring of modular units. The information kiosk provides both visually displayed and printed information to several of users at the same time in response to user input. The information kiosk includes a plurality of modular units which each include a cabinet structure containing a CPU, a touch screen and a removable printer cart for supporting a printer. The cabinet structure includes a first side wall, a second side wall and a door at the from of the cabinet structure between the first and second side walls for enclosing the removable printer cart. The removable printer cart includes a frame, a printer shelf mounted on the frame, and wheels attached to a base of the frame, for facilitating horizontal translation of the cart along a floor surface. The cart is enclosed in an interior space defined by the door of the cabinet when closed, and the first and second side walls of the cabinet. A top shelf of the printer cart is provided with a paper chute and slot for allowing sheets of printed paper to pass from the printer to the user.

15 Claims, 7 Drawing Sheets

INFORMATION KIOSKS

BACKGROUND OF THE INVENTION

1. Field of the Invention

The invention relates to an information kiosk for providing information to users. More particularly, the present invention relates to a user interactive information kiosk for providing information to a user in response to user inputs.

2. Description of the Related Art

Information kiosks are commonly used in large public facilities such as shopping malls and hospitals for providing information to the general public. These information kiosks may be used to provide general information about the facility and to inform visitors of the location of various departments or stores within the facility. Information directories of this type have been developed which are user interactive. User interactive information kiosks allow a user to choose among a selection of alternatives presented by the kiosk for which information is available and to display additional information on a visual display depending on the choices made by the user.

An information kiosk may also be provided with a printer which prints information requested by a user. For example, a kiosk printer may print maps and directions for use in locating a store or department within the facility.

Information kiosks may also be used in airports to provide information to visitors about the airport including gate locations and services. Information kiosks in airports may also provide travel information about accommodations and attractions in the surrounding areas. Information kiosks may also be used in train stations, bus stations, rest areas on interstates or other locations where there are a large number of visitors requiring information.

The limitations of the prior art information kiosks include difficulties in accessing the printer to replace paper and to remover paper jams and insufficient availability of kiosks to users. An additional limitation of the prior art kiosks is the inaccessibility of the kiosks for users confined to wheelchairs.

SUMMARY OF THE INVENTION

The information kiosk of the present invention provides an interactive information source. In one claimed embodiment, the information kiosk includes a cabinet structure and a removable printer cart for supporting a printer. The cabinet structure includes a first side wall, a second side wall, a connecting member connected to the first and second side walls and a door. A hinge is provided for mounting the door to the first side wall near a front edge of the first side wall so that the door can swing between a closed position and a fully open position, and a lock is provided for releasably securing the door in the closed position. The removable cart includes a frame, a printer shelf mounted on the frame, and wheels attached to a base of the frame, for facilitating horizontal translation of the cart along a floor surface. The cart is enclosed in an interior space defined by the door of the cabinet when closed, and the first and second side walls of the cabinet. The cart is dimensioned such that it can pass through an aperture defined by the front edges of the first and second side walls and a front edge of the connecting member when the door is in the fully open position.

According to another aspect of the invention, a modular information station includes at least three modular information units and at least one handicapped modular information unit. The modular information units each include a cabinet structure having first and second side walls and a front wall connecting the first and second side walls. A manual input device is positioned within the cabinet structure for inputting information requests. A central processing unit, a visual display and a printer for outputting requested information are also positioned within the cabinet structure. The side walls of the at least three modular information units and the at least one handicapped modular information unit converge in a direction away from the front wall so that the converging side walls of each unit abut the converging side walls of two other units to form a ring of information units.

BRIEF DESCRIPTION OF THE DRAWING FIGURES

The invention will be described in greater detail with reference to the accompanying drawings in which like elements bear like reference numerals, and wherein.

DETAILED DESCRIPTION

Figure 1:
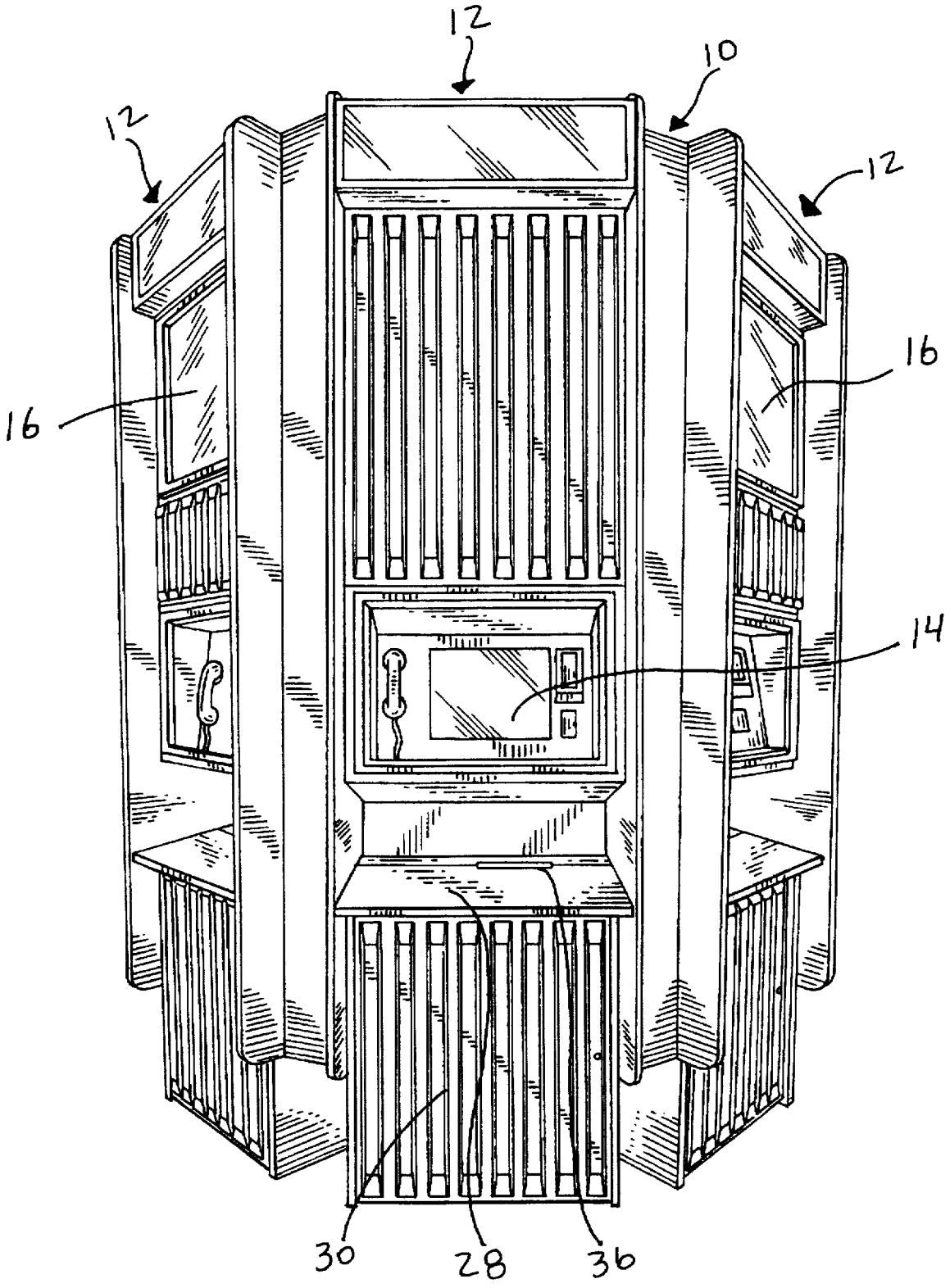
FIG. 1 is a perspective view of a preferred embodiment of the present invention.

An information kiosk 10 according to the present invention is shown in FIG. 1 which includes eight modular units 12 connected to one another to form a ring of modular units. The ring of modular units is most clearly shown in the top and bottom views of FIGS. 5 and 6. The information kiosk provides both visually displayed and printed information to a plurality of users at the same time in response to user inputs.

The information kiosk 10 as shown in the figures is specifically designed for areas having a large number of users. For example, the information kiosk would be particularly useful in an airport or a large shopping mall. In fact, several information kiosks of the configuration shown in the figures could be used in an airport to give both airport information for travelers and tourist information about the surrounding areas. The present invention can be modified for use in smaller facilities by incorporating fewer modular units 12 in each information kiosk 10.

Figure 3:
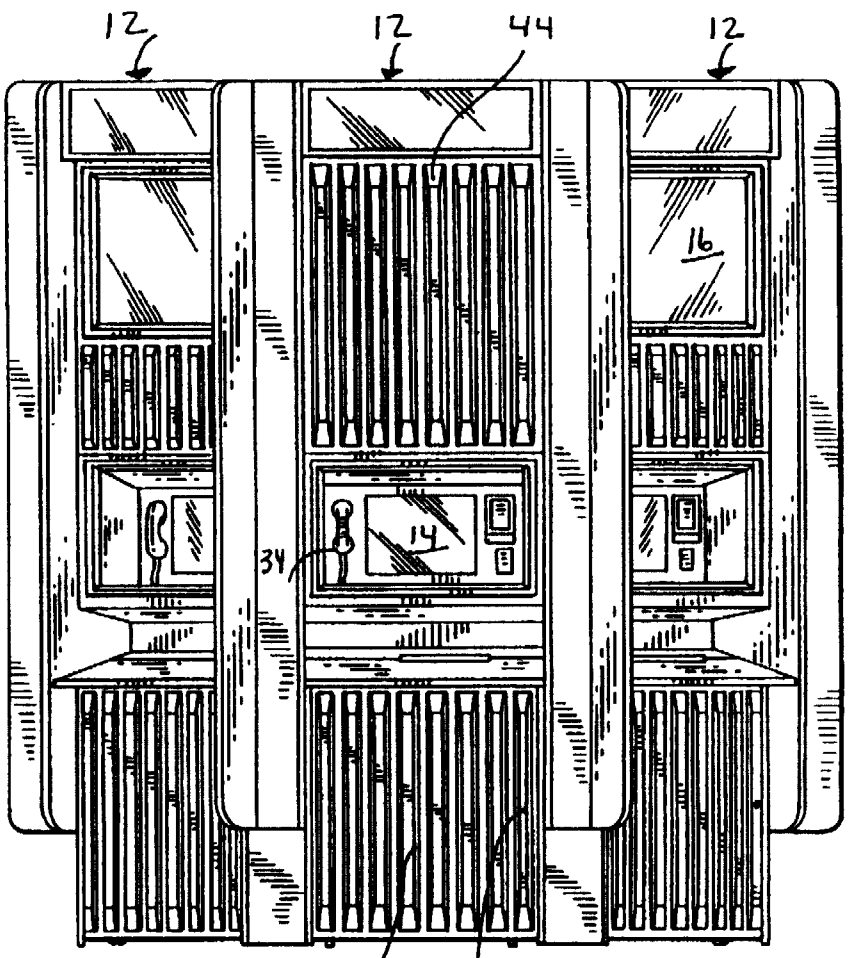
FIG. 3 is a right side view of the invention of FIG. 1 at a 45 degree angle to front view of FIG. 2.
Figure 2:
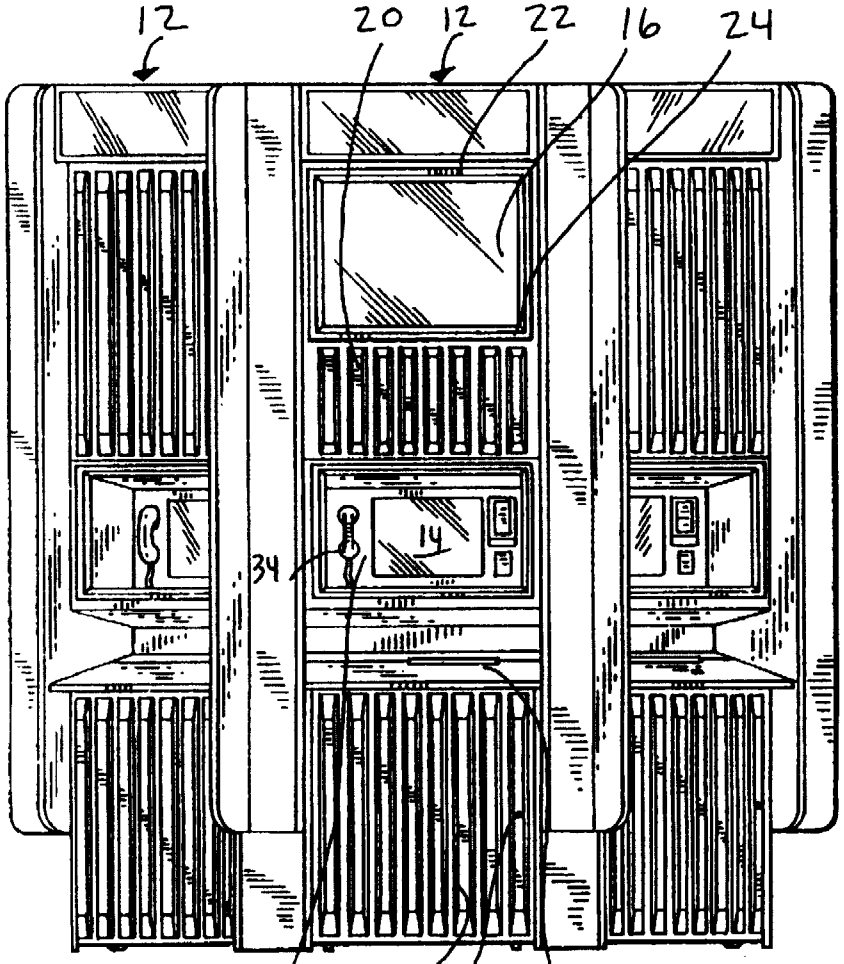
FIG. 2 is a front view of the invention of FIG. 1.
Figure 4:
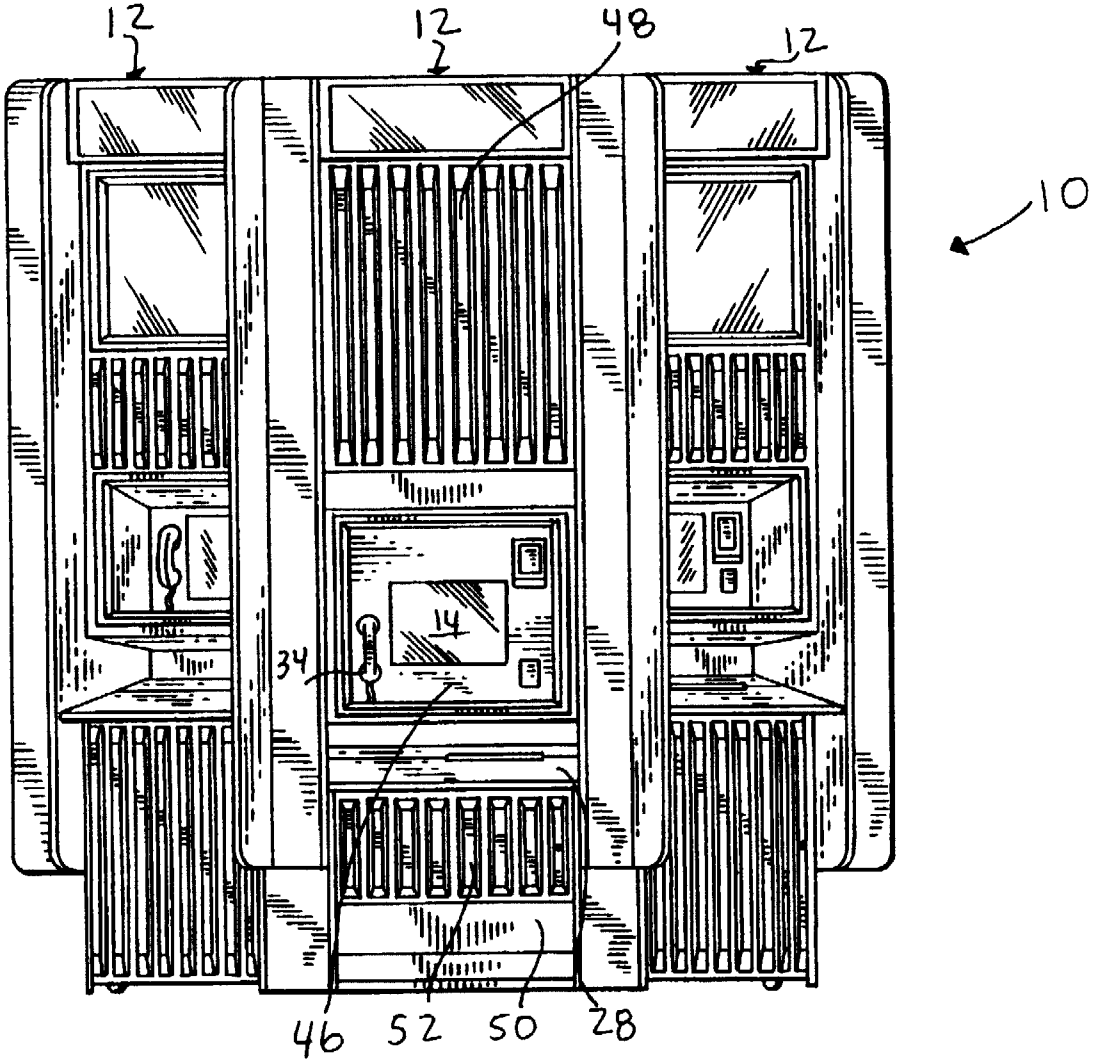
FIG. 4 is a left side view of the invention of FIG. 1 at a 90 degree angle to the front view of FIG. 2.

The information kiosk 10 is formed of modular units 12 which are preferably provided in three different types. The three different types of modular units 12 are incorporated into one kiosk which preferably includes at least one modular unit of each type. Module A is the first type of modular unit 12 which includes a computer touch screen 14 and an additional graphics display screen 16. Module A is shown in the center of FIG. 2. The second type of modular unit is module B which includes a computer touch screen 14 and the third type of modular unit is the handicap accessible module C. Module B is shown in the center of FIG. 3 and Module C is shown in the center of FIG. 4. Each of these modules will be described in more detail below.

Module A which is shown as the center modular unit in FIG. 2 includes a front panel 20 which has an upper opening 22 for the large graphics display screen 16 and a lower opening 24 for the control panel 26. Exposed below the control panel 26 is the upper printer shelf 28 which is the top shelf of the printer cart 56. The printer cart 56 will be discussed further below with respect to FIGS. 7 and 8. A lower portion of the front panel 20, below the upper printer shelf 28, includes a door 30. The door is provided with hinges (not shown) at one side of the front panel and with a lock 32 at the other side of the front panel for locking the door in a closed position. The door 30 provides access to the printer cart 56 for servicing printer.

The graphics display screen 16 is provided with an associated media player such as a VCR or a laser disc player which is preferably mounted within the kiosk structure for displaying graphics presentations on the display screen 16 relating to the information which may be obtained from the information kiosk. For example, the display screen may show videos of the tourist attractions in the surrounding areas. A single media player may be provided for the entire information kiosk, in which case the graphics presentations on each of the display screens 16 will be the same. Alternatively, individual laser disc players may be mounted in each module A, so that, different graphics presentations may be displayed on the display screen 16 of each module A.

The control panel 26 of module A includes the touch screen 14 and a telephone 34 for reaching an information assistance operator. The touch screen 14 allows a user to input information requests directly on the screen. In addition to the touch screen 14, each module A is provided with a central processing unit (not shown) for processing the information input by the user and for outputting the appropriate information to the screen 14 and the printer. The central processing units are mounted within each of the modular units 12.

Figure 5A:
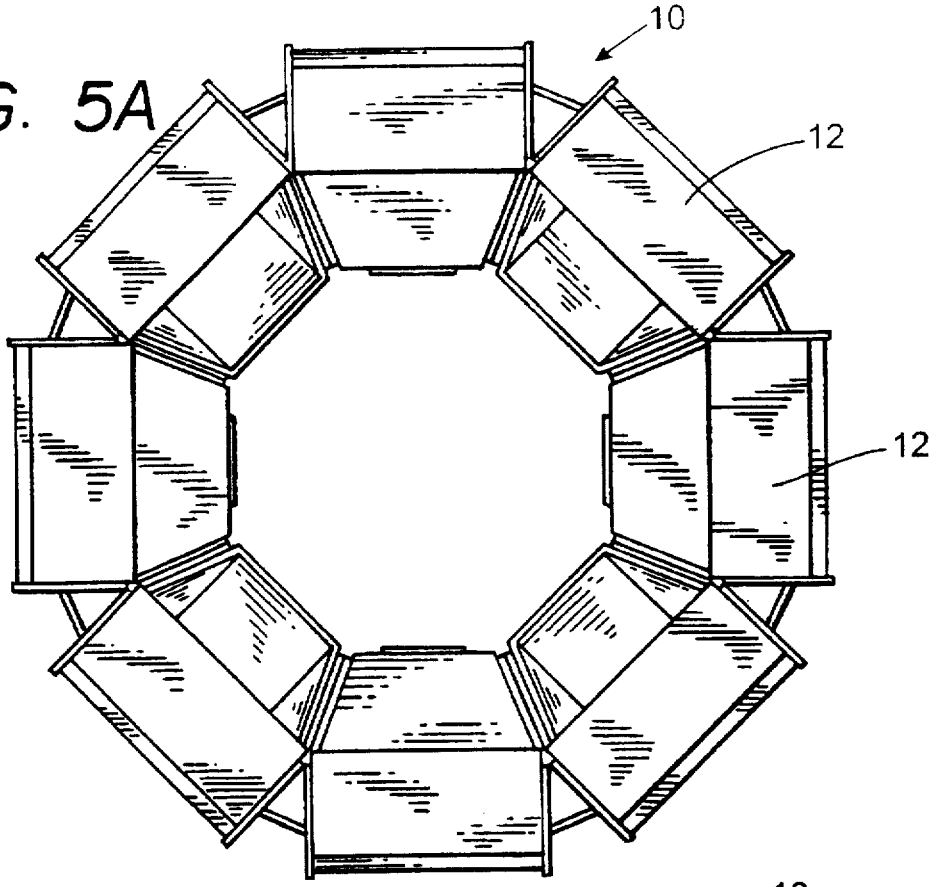
FIG. 5A is a top view of the invention of FIG. 1.
Figure 6:
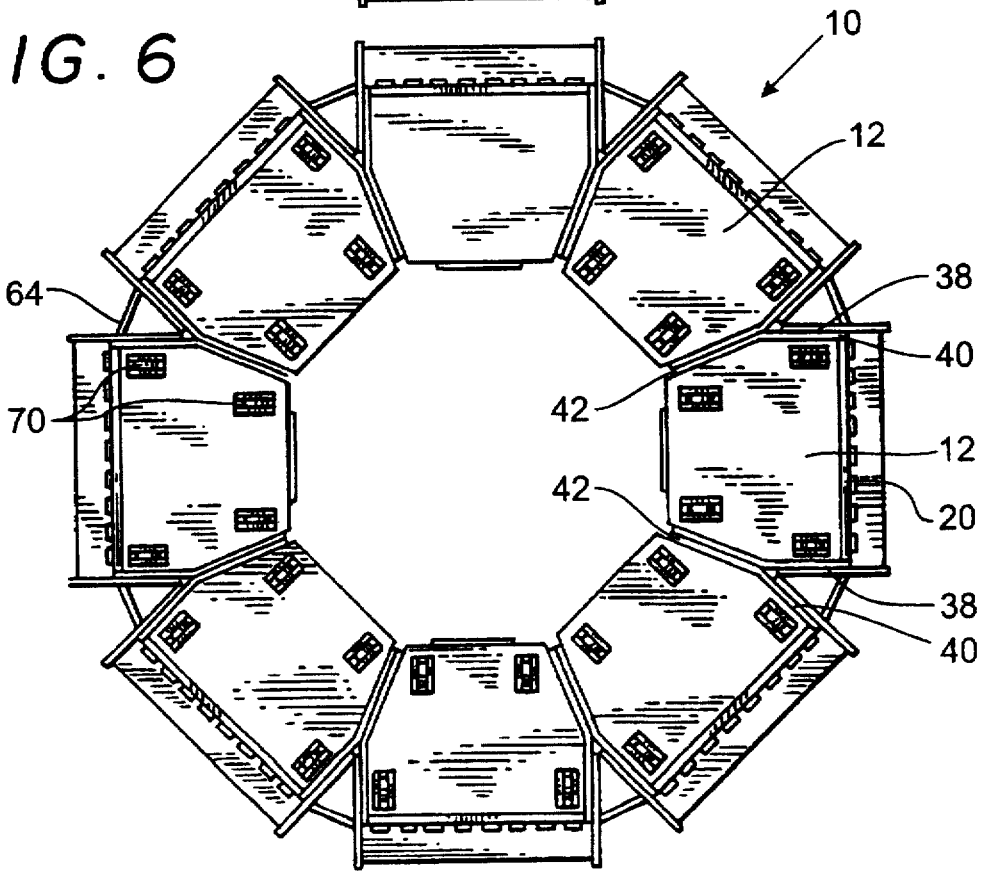
FIG. 6 is a bottom view of the invention of FIG. 1.

The front panel 20 of module A is connected to two side members 38 which are shown in FIG. 6. The side members 38 include front portions 40 which extend perpendicular to the front panel 20 and rear portions 42 which converge in a rearward direction. This allows the rear portions 42 of the side members 38 of one modular unit 12 to be positioned adjacent the rear portions 42 of adjacent modular units 12 so that the front panels 20 of adjacent modular units will be positioned at an angle with respect to each other. A ring of modular units is formed by connecting a plurality of modular units as shown in FIGS. 5A and 6.

When a plurality of modular units are connected to form a ring as shown in FIGS. 5A and 6, an A-shaped member 64 is provided to fill the gaps between the front portions 40 of the side members of modular units. The sides of the A-shaped member help to provide privacy for users of the modular units.

Figure 5B:
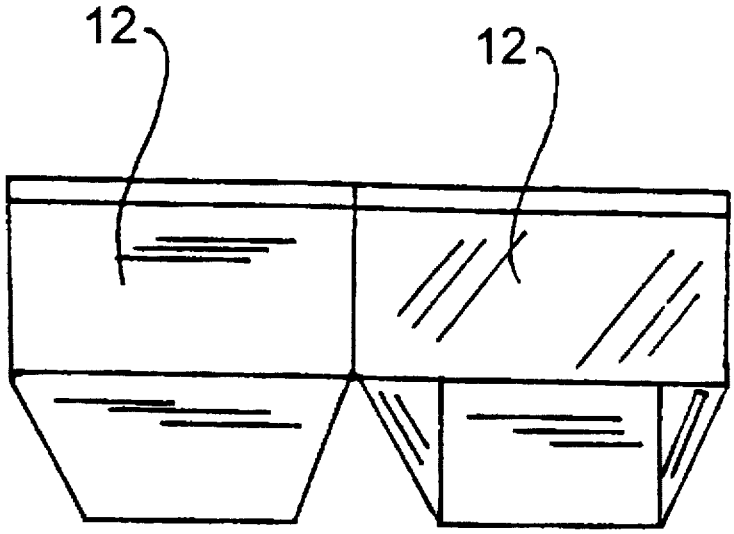
FIG. 5B is a top view of a second arrangement of the invention.

Alternatively, the front portions 40 of the side members 38 of one modular unit 12 may be positioned adjacent the front portions 40 of adjacent modular units 12 as shown in FIG. 5B. In this arrangement, the modular units are positioned in a row with the front panels 20 aligned.

The second modular unit, module B, is shown in the center of FIG. 3. Module B differs from module A discussed above in that the front panel 44 of module B is not provided with an upper opening for a large graphics display screen. The graphics display screen and associated laser disc players are provided only in module A. Module A is preferably alternated with other modular units such as module B around the information kiosk 10 so that a large graphics display screen will be visible from all sides of the information kiosk.

Figure 7:
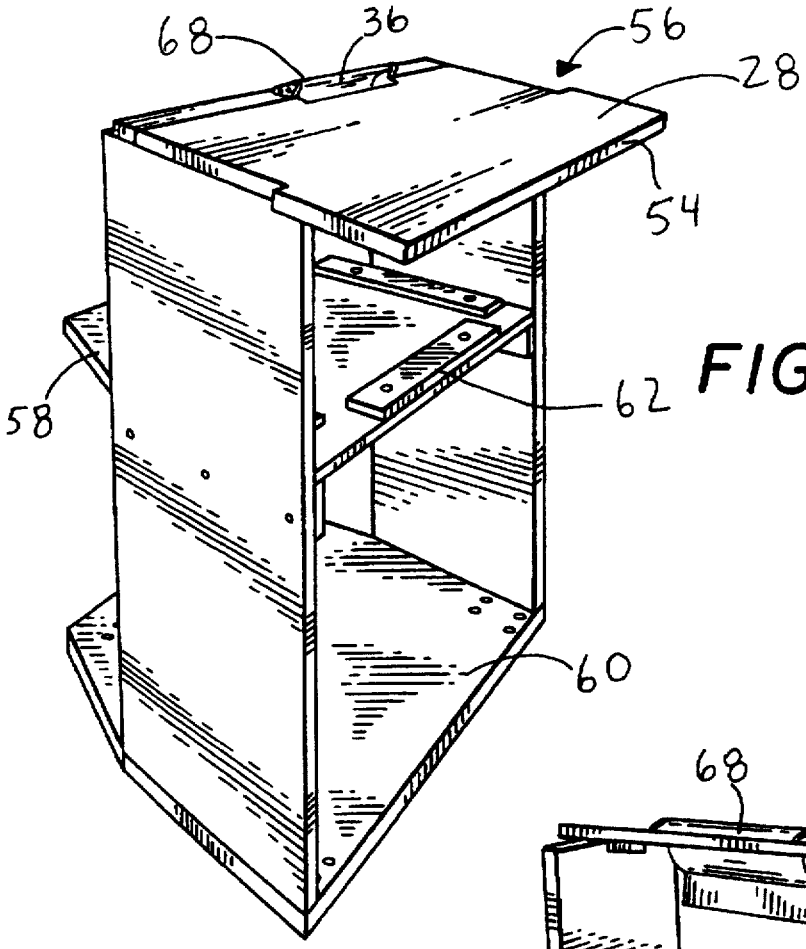
FIG. 7 is a perspective view of a front of the printer cart of the present invention.
Figure 8:
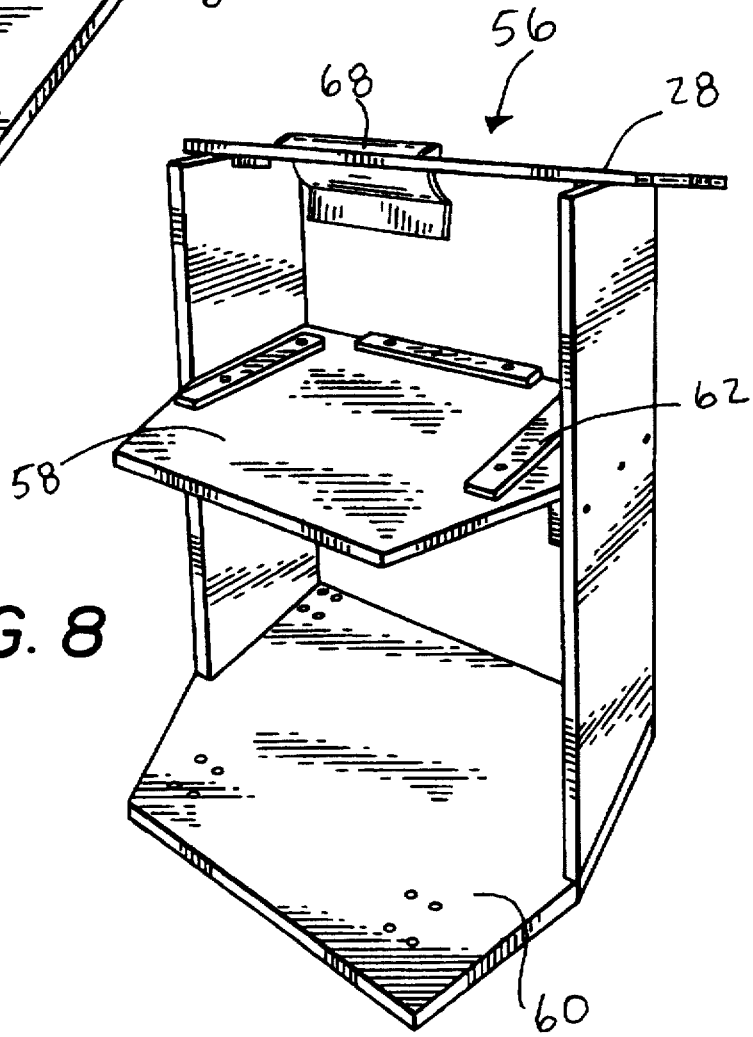
FIG. 8 is a perspective view of a back of the printer cart of FIG. 7.

The printer carts 56 which are used in modules A and B will now be discussed in detail. As shown in FIGS. 7 and 8, the printer cart 56 includes an upper printer shelf 28, a center printer shelf 58 and a lower printer shelf 60. The upper printer shelf 28 is provided with a paper slot 36 and an associated paper chute 68 for dispensing printed sheets. The paper chute 68 is attached to the paper slot 36 at an upper end and is concavely curved from the bottom to the top when viewed from the front of the printer cart. The upper printer shelf 28 includes an overhanging front edge 54 which extends beyond the front of the door 30 when the printer cart is positioned within the kiosk and the door 30 is in the closed position.

The center printer shelf 58 is provided with moldings 62 for assisting in positioning a printer (not shown) on the center printer shelf 58. When the printer is correctly positioned on the center printer shelf 58, a sheet of paper which has been printed by the printer is directed by the paper chute 68 through the paper slot 36. The upper printer shelf 28 is positioned at an angle with the front 54 of the shelf being lower than the back. The angled upper printer shelf 28 allows the printed sheets of paper to be easily accessed and also provides a writing surface.

The lower printer shelf 60 may be used to store supplies such as printer paper. Four wheels 70 are preferably attached to the lower surface of the lower printer shelf 60. The wheels which are shown in FIG. 6 allow the printer cart to be rolled out of the kiosk for easy access to the printer.

The third modular unit, module C, is shown in the center of FIG. 4. Module C allows access for a user in a wheelchair by providing a lowered control panel 46 with a touch screen 14 which is angled downward for ease of access from a wheelchair. In addition, a lower portion of the front panel 48 is provided with an opening 50 which will allow the foot supports of a wheelchair to extend partially into the module so that a user in a wheelchair may access the information kiosk. A printer door 52 is provided in module C which is smaller than the doors provided in modules A and B and accommodates a printer shelf (not shown) rather than an entire printer can. The upper printer shelf 28 of module C is positioned slightly lower than the printer shelves 28 of modules A and B to provide access to a user in a wheelchair. Module C otherwise includes the same features as module B including a touch screen 16, a telephone 34, and a CPU.

In operation, a user approaches one of the modular units of the information kiosk 10 and inputs information requests on the touch screen. The user then has the option of viewing the selected information on the touch screen 14 or printing the information. Up to eight users can use the information kiosk at the same time without affecting one another because each of the modular units includes a separate CPU.

Figure 9:
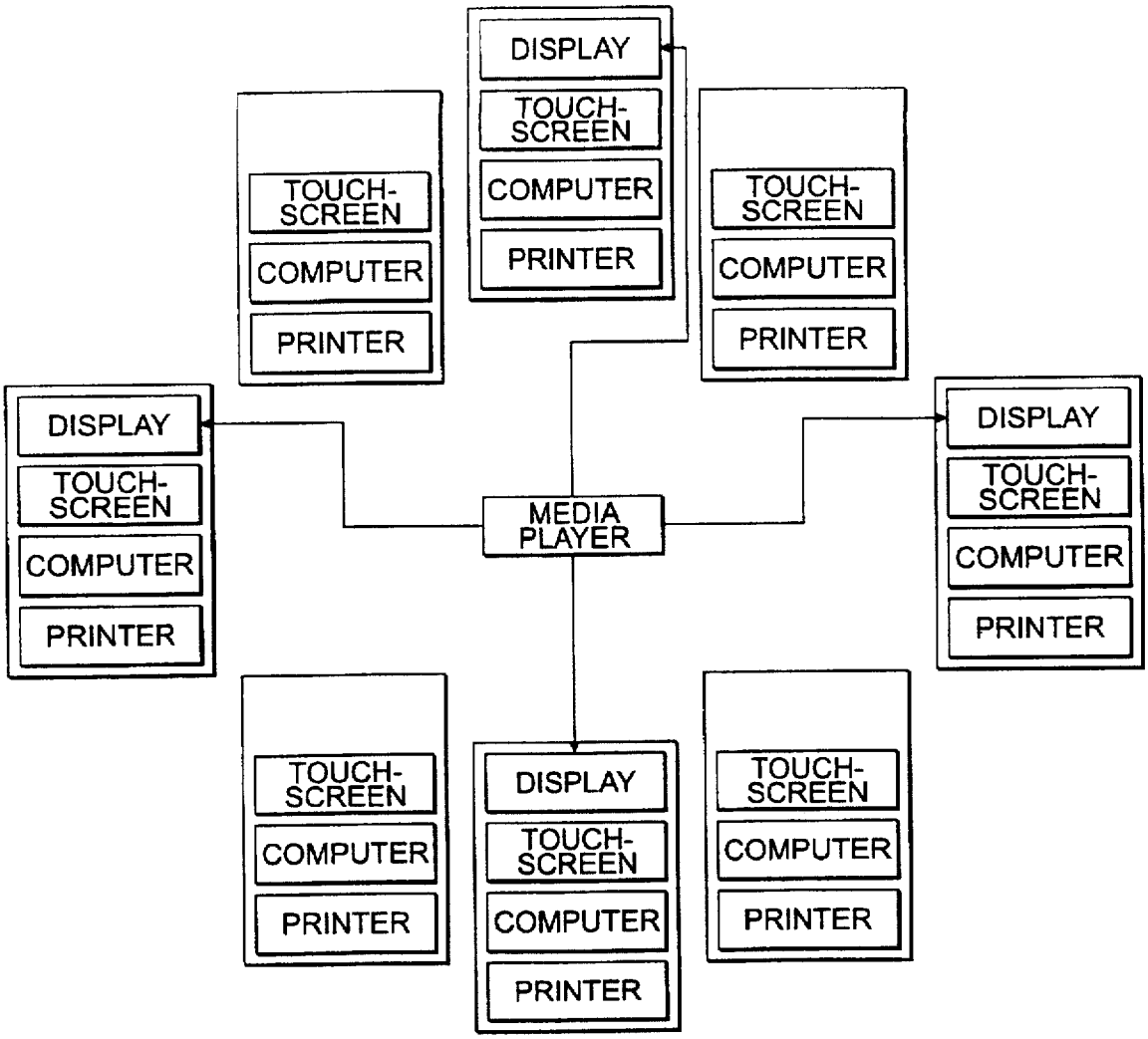
FIG. 9 is a functional block diagram of a system according to the present invention.

An overall configuration of the electronic aspects of the system is shown in FIG. 9. As can be seen there, the system is made up of a set of modules, eight in the embodiment shown. Each module has its own computer, printer, and touchscreen, the touchscreen serving as a combined input/display device. In addition, four of the modules also have a second display, each of which is connected to a shared media player.

While the invention has been described in detail with reference to a preferred embodiment thereof, it will be apparent to one skilled in the art that various changes can be made, and equivalents employed without departing from the spirit and scope of the invention.

What is claimed is:

1. Apparatus comprising:

a cabinet structure including a first side wall, a second side wall, a door, a hinge for mounting the door to the first side wall near a front edge of the first side wall so that the door can swing between a closed position and a fully open position, and a lock for releasably securing the door in the closed position; and a cart including a frame, a first shelf mounted on the frame, and means, attached to a base of the frame, for facilitating horizontal translation of the cart along a floor, a bottom portion of said cart being enclosed in, and an upper portion of said cart not being within, an interior space defined by the door when closed, and the first and second side walls, and being dimensioned such that the bottom portion can pass between the front edges of the first and second side walls when the door is in the fully open position.

2. Apparatus as claimed in claim 1, wherein the upper portion includes a second shelf which is positioned to be accessible to a user when the bottom portion of the cart is enclosed in the interior space defined by the door when closed, and the first and second side walls.

3. Apparatus as claimed in claim 2, wherein the second shelf includes a slot dimensioned to permit a piece of paper to pass therethrough, and further includes a chute member, fixedly mounted with respect to the slot, and wherein said apparatus further includes a printer positioned on the first shelf so that a paper output of the printer is positioned adjacent the chute member when the bottom portion of the cart is enclosed in the interior space, the chute guiding a piece of paper from the printer through the slot in the second shelf.

4. Apparatus as claimed in claim 1, further comprising a manual input device for input of information by a user, a first visual display and a central processing unit capable of receiving the information input by the user and outputting output signals to the first visual display.

5. Apparatus as claimed in claim 4, further comprising a second visual display and a media player for storing images to be displayed on the second visual display.

6. A modular information station comprising:

at least three modular information units each including a cabinet structure having first and second side walls, a door, a hinge for mounting the door to the first side wall near a front edge of the first side wall so that the door can swing between a closed position and a fully open position, and a lock for releasably securing the door in the closed position, a cart including a frame, a first shelf mounted on the frame, means, attached to a base of the frame, for facilitating horizontal translation of the cart along a floor, at least a bottom portion of said cart being enclosed in an interior space defined by the door when closed, and the first and second side walls, and being dimensioned such that it can pass between the front edges of the first and second side walls when the door is in the fully open position, a manual input device positioned within the cabinet structure for inputting information requests, a central processing unit for processing information requests, a visual display connected to the central processing unit and a printer connected to the central processing unit for outputting requested information; and at least one handicapped modular information unit adapted for use by a user in a wheelchair, the handicapped modular information unit including a cabinet structure having first and second side walls, a manual input device positioned within the cabinet structure for inputting information requests, a central processing unit for processing information requests, a visual display connected to the central processing unit and a printer connected to the central processing unit for outputting requested information;

wherein the side walls of the at least three modular information units and the at least one handicapped modular information unit converge in a direction away from the front wall so that the converging side walls of each unit abut the converging side walls of two other units to form a ring of information units.

7. The modular information station of claim 1, wherein the first shelf of each cart holds a printer and wherein each cart also includes a second shelf, wherein the second shelf includes a slot dimensioned to permit a piece of paper to pass therethrough, and further includes a chute member connected to the slot for directing paper which has been printed by the printer through the slot.

8. The modular information station of claim 6, wherein a front wall of the at least one handicapped modular information unit includes a lower opening for receiving a portion of a wheelchair and wherein the visual display is positioned to be read by a user in a wheelchair.

9. The modular information station of claim 5, wherein at least one of the at least three modular information units further includes a graphics display screen and means for displaying graphics presentations on the graphics display screen.

10. Apparatus comprising:

a cabinet structure including a first side wall, a second side wall, a door, a hinge for mounting the door to the first side wall near a front edge of the first side wall so that the door can swing between a closed position and a fully open position, and a lock for releasably securing the door in the closed position, the first and second side walls being beveled to have a forward portion substantially perpendicular to the door in the closed position and a rearward portion angled with respect to the forward portion such that the rearward portions of the first and second side walls converge in a rearward direction; and a cart including a frame, a first shelf mounted on the frame, and means, attached to a base of the frame, for facilitating horizontal translation of the cart along a floor, at least a bottom portion of the cart being enclosed in an interior space defined by the door when closed, and the first and second side walls, and being dimensioned such that it can pass between the front edges of the first and second side walls when the door is in the fully open position.

11. Apparatus as claimed in claim 10, wherein the cabinet structure is a first cabinet structure, and the apparatus further comprises a second cabinet structure disposed laterally adjacent the first cabinet structure, the second cabinet structure comprising a third side wall and a fourth side wall, wherein the third and fourth side walls are beveled to have a forward portion substantially parallel to one another and a rearward portion angled with respect to the forward portion such that the rearward portions of the third and fourth side walls converge in a rearward direction.

12. Apparatus as claimed in claim 11, wherein the first and second cabinet structures are arranged such that the rearward portion of the second side wall is substantially parallel to and in abutment with the rearward portion of the third side wall.

13. Apparatus as claimed in claim 12, wherein the apparatus further comprises a spacer member which is A-shaped in cross-section and positioned in a V-shaped gap defined by the second and third side walls.

14. Apparatus as claimed in claim 11, wherein the first and second cabinet structures are arranged such that the forward portion of the second side wall is substantially parallel to and in abutment with the forward portion of the third side wall.

15. Apparatus comprising:

a cabinet structure including a first side wall, a second side wall, a door, a hinge for mounting the door to the first side wall near a front edge of the first side wall so that the door can swing between a closed position and a fully open position, and a lock for releasably securing the door in the closed position; and a cart including a first shelf positioned to be accessible to a user when at least a bottom portion of the cart is enclosed in an interior space defined by the door when closed, the first side wall, and the second side wall, the first shelf including a front edge which projects over the door when the cart is positioned in the interior space and the door is closed, and means, attached to a base of the cart, for facilitating horizontal translation of the cart along a floor, at least a bottom portion of the cart being enclosed in the interior space and being dimensioned such that the bottom portion can pass between the front edges of the first and second side walls when the door is in the fully open position.

* * * * *

UNITED STATES PATENT AND TRADEMARK OFFICE

CERTIFICATE OF CORRECTION

PATENT NO. : 5,702,166

DATED : December 30, 1997

INVENTOR(S) : James Michael LEE

It is certified that error appears in the above-indentified patent and that said Letters Patent is hereby corrected as shown below:

IN THE ABSTRACT, line 6, delete "of";

Column 6, line 18 change "1" to --6--.

Signed and Sealed this

Eighth Day of September, 1998

*Attest:*

*Attesting Officer*

BRUCE LEHMAN

*Commissioner of Patents and Trademarks*